US011326389B2

(12) United States Patent
Pfaltz et al.

(10) Patent No.: US 11,326,389 B2
(45) Date of Patent: May 10, 2022

(54) INSULATING GLASS ELEMENTS FOR MULTIPLE-PANE DOORS WITH A TRANSPARENT EDGE COMPOSITE AND METHOD FOR PRODUCING THE INSULATING GLASS ELEMENTS

(71) Applicants: Dieter Pfaltz, Grossdittmannsdorf (DE); Christoph Möllers, Dresden (DE)

(72) Inventors: Dieter Pfaltz, Grossdittmannsdorf (DE); Christoph Möllers, Dresden (DE)

( * ) Notice: Subject to any disclaimer, the term of this patent is extended or adjusted under 35 U.S.C. 154(b) by 247 days.

(21) Appl. No.: 16/334,753

(22) PCT Filed: Sep. 21, 2017

(86) PCT No.: PCT/DE2017/100805
§ 371 (c)(1),
(2) Date: Mar. 20, 2019

(87) PCT Pub. No.: WO2018/054427
PCT Pub. Date: Mar. 29, 2018

(65) Prior Publication Data

US 2020/0355019 A1 Nov. 12, 2020

(30) Foreign Application Priority Data

Sep. 21, 2016 (DE) ..... 102016117849.7
May 7, 2017 (DE) ..... 102017109760.0

(51) Int. Cl.
*E06B 3/663* (2006.01)
*A47F 3/04* (2006.01)
(Continued)

(52) U.S. Cl.
CPC ..... *E06B 3/66333* (2013.01); *A47F 3/0434* (2013.01); *E06B 3/66352* (2013.01);
(Continued)

(58) Field of Classification Search
CPC ..... E06B 3/66333; E06B 3/66352; E06B 3/67326; E06B 2003/66338; A47F 3/0434; A47F 3/005
See application file for complete search history.

(56) References Cited

U.S. PATENT DOCUMENTS 3,919,023 A * 11/1975 Bowser ..... E06B 3/66342 156/107
2010/0139193 A1* 6/2010 Goldberg ..... B32B 27/08 52/309.3
2017/0362882 A1* 12/2017 Boucher ..... E06B 3/66352

FOREIGN PATENT DOCUMENTS

WO 2008143063 A1 11/2008
WO 2016091954 A1 6/2016

* cited by examiner

*Primary Examiner* — Donald J Loney
(74) *Attorney, Agent, or Firm* — Michael Soderman

(57) ABSTRACT

The aim of the invention is to not use, partially or completely, the inner aluminium profile as a spacer in multi-pane doors of refrigerators whilst retaining the required stability and also to replace all other spacers with transparent glass spacer. The invention also relates to methods for the production thereof. The insulating glass elements for the multiple-pane doors with a transparent edge composite for use in shop fittings, refrigerator construction and special cabinet construction, comprise glass spacers (1) between the base disk (4) and the cover disk (4) in the vertical regions of doors and in the upper horizontal region or in both horizontal regions, aluminum or plastic spacers (2), and EVA film sheets (3) between the base disk (4) and the spacers (1, 2) and between the spacers (1, 2) and the cover disk (4), the EVA film sheets (3) are arranged in the four edge regions overlapping the vertical spacers (2) to the horizontal spacers (1). In another embodiment, the EVA film is replaced with ethylene vinyl acetate copolymer granulates, which is heated by means of a metering device and is applied in a liquefied
(Continued)

form at the desired positions as thread-shaped strips. The crosslinking between the glass and the ethylene vinyl acetate copolymer occurs in the lamination oven.

5 Claims, 1 Drawing Sheet

(51) Int. Cl.
*E06B 3/673* (2006.01)
*A47F 3/00* (2006.01)

(52) U.S. Cl.
CPC ..... *E06B 3/67326* (2013.01); *A47F 3/005* (2013.01); *E06B 2003/66338* (2013.01)

INSULATING GLASS ELEMENTS FOR MULTIPLE-PANE DOORS WITH A TRANSPARENT EDGE COMPOSITE AND METHOD FOR PRODUCING THE INSULATING GLASS ELEMENTS

CROSS REFERENCE TO RELATED APPLICATIONS

This application is the U.S. national stage of International Application No. PCT/DE2017/100805, filed on 2017 Sep. 21. The international application claims the priority of DE 102016117849.7 filed on 2016 Sep. 21 and the priority of DE 102017109760.0 filed on 2017 May 7; all applications are incorporated by reference herein in their entirety.

BACKGROUND

Insulating glass elements for multi-pane doors with transparent edge seal for use in shop fitting, refrigerated cabinet construction and special display case construction.

Insulating glass is used in the areas of refrigerated cabinet construction, shop fitting and special display case construction in order to be able to store food in particular and present it to customers at the same time at temperatures of 5 degrees C. or below 5 degrees C. in the so-called deep-freeze range. Refrigerated shelves with glass doors are also used for this purpose. Until now, the spacers between the two glass door panes installed parallel to each other were mainly aluminum spacers based on the same principle as for insulating glazing in the building industry.

In order to achieve a tight bond between the glass pane and the spacer, a butyl cord was applied in practice using an extruder. A black compound which hardens permanently elastic. An aluminum profile is perforated towards the inside of the pane. In the cavity of the aluminum profiles there is a water-binding material, e.g. silica gel or molecular sieve. The air trapped between the two panes contains moisture, which would condense if the dew point were to fall below, as precipitation on the glass panes inside the glass laminate. The water-binding material now binds this moisture up to the maximum saturation limit of this material. If there is no new air between the two panes due to leaks in the butyl cord and the outer sealing compound, e.g. polysulphide, the risk of condensation is permanently eliminated.

Finally, the introduced aluminum profile is connected to the outside of the glass by a circumferential sealing compound. Sealing compound and butyl cord thus form a double sealing system.

Thus, in the publication DE 20 2013 012 171 U1, a refrigerator for the storage of foodstuffs is provided with an access opening which lies in a vertical plane and which can be closed by a pivotable or movable and multi-glazed refrigerator door, wherein the refrigerator door has at least two transparent glass panes which are spaced apart from one another by edge-side spacing elements, wherein a vertically transparent spacing element made of a transparent material and no supporting frame element is provided at a transparent vertical edge of the refrigerator door, the vertical transparent spacer element connecting the two glass panes to one another and holding them at a defined distance from one another, the spacer element being in the form of a hollow profile at the lower horizontal edge of the refrigerator door, the hollow profile having several openings towards the intermediate space between the glass panes, and the hollow spacer element being filled with drying agent which serves to absorb moisture from the intermediate space.

In the building industry, the composite elements are embedded in a frame, i.e. the sealing area is covered by the window frame and is therefore not visible to the observer. This is not the case for doors in refrigerated cabinet construction-shop fitting. The vertical spacer profiles of the composite elements made of aluminum or other conventional materials form a visual barrier for the customer who wants to see the presentation of the goods undisturbed and thus make purchasing decisions.

SUMMARY

The task of the invention is to partially or completely omit the inner aluminum profile as a spacer on multi-pane doors of refrigerated cabinets while maintaining the required stability and to replace all other spacers with transparent glass spacers and to create appropriate manufacturing processes.

Insulating glass elements for multi-pane doors with transparent edge seal for use in shop fitting, refrigerated cabinet construction and special display case construction, where aluminum or plastic spacers (2) are arranged between the base pane (4) and the cover pane (4) in the vertical edge area of the door and in the upper horizontal area glass spacers (1) or in both horizontal areas and between the base pane (4) and the spacers (1, 2) and between the spacers (1, 2) and the cover plate (4) there are EVA film strips (3), the EVA film strips (3) being arranged overlapping at the four corner points from the horizontal spacers (2) to the vertical spacers (1). In one variant, the EVA film is replaced by an ethylene-vinyl acetate copolymer granulate, which is heated by a dosing device and applied liquefied at the desired points as a thread-like strip. The cross-linking between glass and the ethylene-vinyl acetate copolymer takes place in a laminating oven.

DETAILED DESCRIPTION

The task of the invention is to partially or completely omit the inner aluminum profile as a spacer on multi-pane doors of refrigerated cabinets while maintaining the required stability and to replace all other spacers with transparent glass spacers and to create appropriate manufacturing processes.

The connection between the glass spacer, preferably a soda-lime glass rod, and the two glass panes is made by means of a copolymer, preferably with ethylene-vinyl acetate copolymer in film form or granulate form by lamination. This creates a permanent bond and at the same time prevents a cold bridge.

The composite is based on crystal-clear three-dimensional cross-linking. The use of such glass doors in deep-freeze areas is possible without any problems. There is no condensation due to the temperature falling below the dew point. The type of cross-linking of the copolymer with the glass reliably excludes delamination, penetration of moisture and detachment phenomena between copolymer and glass.

Examples of how the invention can be implemented with the technical details are explained in more detail in the drawings.

BRIEF DESCRIPTION OF THE DRAWINGS

The following is shown.

DETAILED DESCRIPTION OF THE PREFERRED EMBODIMENTS

Figure 1:
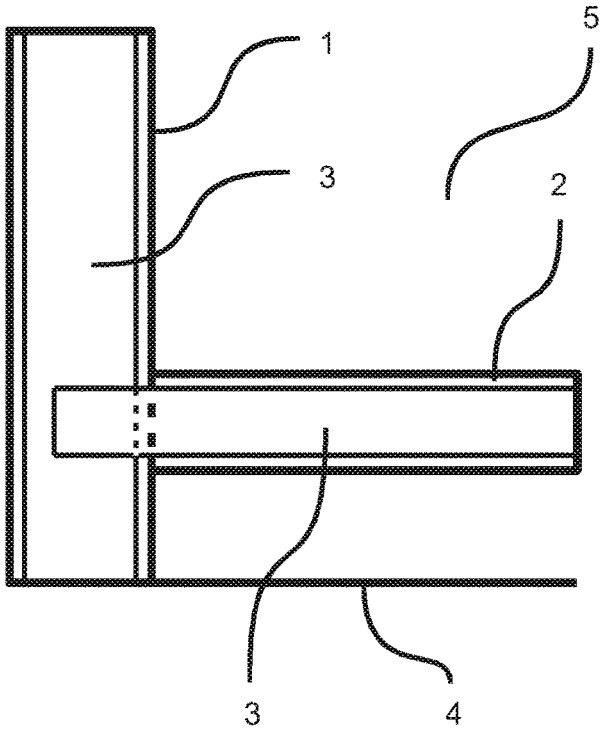
FIG. 1 The top view of a section of a corner of a glass door.
Figure 2:
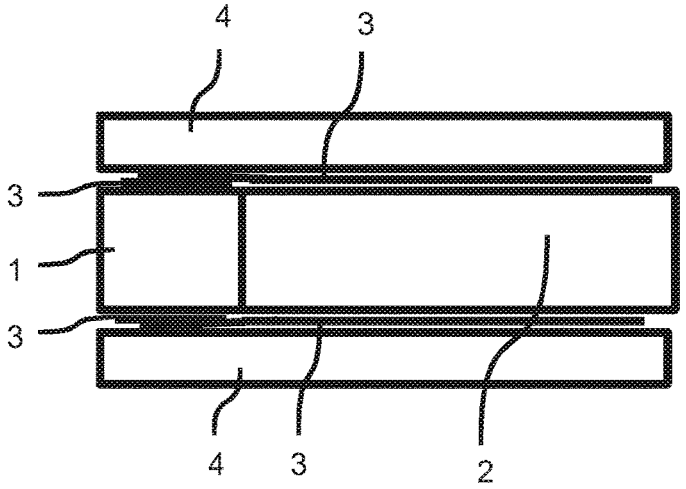
FIG. 2 The side view of a section of a corner of a glass door.

The flat glass 4 used in each case can have different thicknesses and consist of different types of glass, including special technical glass, and is conventionally cut, ground and washed.

The glass spacers 1, preferably consisting of a soda lime glass, are cut and ground with a polished edge and a light seam.

The EVA film 3 used, preferably with a thickness of 0.38 mm or a multiple of this thickness, is cut strip-like into EVE film tapes 3 according to the support width of the glass spacer 1.

The necessary conventional spacers 2, preferably aluminum spacers 2, are installed at least horizontally at the bottom of the insulating glass door and are provided with holes for the valves. These are filled with a desiccant (silica gel or molecular sieve). To prevent the molecular sieve from escaping, a foam plug of a few centimeters is inserted into the respective profile ends. Corner connectors, preferably made of plastic, are inserted into the profile ends.

Aluminum spacers 2 can also be replaced by plastic spacers 2.

On the base pane 4 of the insulating glass element, the EVA films 3 cut into strips are placed on the base pane 4 (flush with the outer edge of the pane). The ends of the film strips 3 overlap at the longitudinal strips and cross strips with 3 to 5 mm. This means that a closed system is achieved during the lamination process in the oven, which is essential for the high gas tightness of the insulating glass pane.

The glass spacers 1 lie on the EVA film tapes 3, also flush with the outer edge of the pane. At right angles to the glass spacers 1 of the long sides, the aluminum spacers 2 are placed set back approx. 10 to 15 mm from the narrow glass edge of the base pane 4.

The frame formed in this way on the base pane 4 gives the distance between the base pane 4 and the cover pane 4. These distances may vary greatly, usually not less than 8 mm.

This frame, consisting of the longitudinally placed glass spacers 1 and the crosswise placed aluminum spacers 2, is again fitted with narrow EVA film strips 3. The width of these EVA film tapes 3 is determined by the width of the spacers 1, 2. The EVA film tapes 3 are not wider on the inside and outside, rather somewhat narrower to prevent soft ethylene-vinyl acetate copolymer from entering the space between the panes 5 during the lamination process. The EVA film tapes 3 overlap again at the respective corner points. The cover pane 4 is placed on these EVA film tapes 3.

The laminated glass elements thus consist of a composite pane (insulating glass doors) of a base pane 4 and a cover pane 4 with spacers 1 and 2 between them, and the lower EVA film tapes 3 between the base pane 4 and the spacers 1 and 2, and the upper EVA film tapes 3 between the spacers 1 and 2 and the cover pane 4.

Before inserting the combined insulating glass elements into the laminating oven, the insulating glass elements are clamped. This prevents the individual elements from shifting during transport and insertion into the laminating oven, while at the same time exerting pressure on the EVA films, resulting in an optimum connection between the glass panes 4 and spacers 1 and 2.

After lamination, the top and bottom edges of the composite element are sealed in the conventional manner, i.e. the space between the top and bottom panes of glass 4 up to the crosswise inserted aluminum spacer 2 is filled with a suitable sealing compound, preferably black polysulphide. The space between the panes (SZR) 5 is also filled with an inert gas, preferably argon or krypton, in a conventional manner. The filling process takes place via the valves built into the aluminum spacers 2.

For special applications, multiple composite panes can also be produced using three panes 4 and more.

The cover and base pane 4 can consist of normal float glass of different glass thicknesses. However, flat glass 4 of a different manufacturing type can also be used if the thickness tolerances permit this laminated pane.

Special flat glass with soft and hard-coated surfaces, toughened safety glass (ESG) and laminated safety glass (VSG) can also be used in this composite.

In addition to the production of flat (planar) laminated elements, it is also possible to produce elements with curved flat glass 4, e.g. cylindrical panes 4 and panes 4 with multiple radii. In these cases, the glass spacers 1 are first brought to the desired shape in a glass bending furnace by gravity bending and then inserted.

The EVA films can also be replaced by the ethylene-vinyl acetate copolymer in granular form, liquefied by heating. This changes the procedure. Preferably the process can be automated by the use of robots. In the process using the ethylene-vinyl acetate copolymer in granular form, the copolymer is liquefied in a metering device at 130 to 145 degrees Celsius and applied in a metered form as a filamentary strip to the edge of the base pane 4 of the insulating glass element at half the spacer thickness on the base pane 4. Then the glass spacers 1 are also placed flush with the outer glass edge on the strip of the copolymer, at right angles to the glass spacers 1 of the long sides, the aluminum spacers 2 or plastic spacers 2 are placed approx. 10 to 15 mm back from the narrow glass edge of the base pane 4. A thread-shaped strip of copolymer is applied to all spacers 1, 2 on these frames consisting of the longitudinally placed glass spacers 1 and the crosswise placed aluminum spacers 2 or plastic spacers 2 on the base pane 4. The cover pane 4 is placed on it and the entire glass composite is clamped. Then the laminating process takes place in the laminating oven at approx. 135 degrees Celsius and after completion of the laminating process the edge sealing of the aluminum spacer 2 or plastic spacer 2 and the contact of the insulating glass element with an inert gas takes place in the conventional way.

LIST OF REFERENCE NUMERALS

1—glass spacer, spacer
2—aluminum spacer, spacer, plastic spacer, spacer
3—EVA film, EVA film tape, film strips
4—pane, glass pane, flat glass, base pane, cover pane
5—space between panes, SZR

The invention claimed is:

1. Insulating glass elements for multi-pane doors with transparent edge seal for use in shop fitting, refrigerated cabinet construction and special display case construction, characterized in that:

glass spacers (1) are arranged between a base pane (4) and a cover pane (4) in vertical edge areas of the door, glass spacers (1) are arranged in an upper horizontal area, or aluminum or plastic spacers (2) are arranged in both horizontal regions, and between the base pane (4) and the spacers (1, 2) and between the spacers (1, 2) and the cover pane (4) there are ethylene-vinyl acetate copolymer film strips (3), and the ethylene-vinyl acetate copolymer film strips (3)

are arranged to overlap at the four corner points from the horizontal spacers (2) to the vertical spacers (1).

2. Insulating glass elements according to claim 1, characterized in that the glass spacers (1) are preferably cut from a soda-lime glass.

3. Insulating glass elements according to claim 1, characterized in that the glass spacers (1) are ground and have a polished edge with a seam of 0.5 mm.

4. Insulating glass elements according to claim 1, characterized in that the ethylene-vinyl acetate copolymer film (3) has a thickness of 0.38 mm or a multiple of this thickness.

5. Insulating glass elements for multi-pane doors with transparent edge seal for use in shop fitting, refrigerated cabinet construction and special display case construction, characterized in that:

glass spacers (1) are arranged between a base pane (4) and a cover pane (4) in vertical edge areas of the door, glass spacers (1) are arranged in an upper horizontal area, or aluminum or plastic spacers (2) are arranged in both horizontal regions, and between the base pane (4) and the spacers (1, 2) and between the spacers (1, 2) and the cover pane (4) there is an ethylene-vinyl acetate copolymer in granular form, as a multiple crosslinking agent liquified by heating, and the ethylene-vinyl acetate copolymer in granular form is arranged to overlap at the four corner points from the horizontal spacers (2) to the vertical spacers (1).

* * * * *